US007199775B2

(12) United States Patent
Igarashi et al.

(10) Patent No.: US 7,199,775 B2
(45) Date of Patent: Apr. 3, 2007

(54) DISPLAY DEVICE ARRAY SUBSTRATE AND DISPLAY DEVICE

(75) Inventors: Kazuaki Igarashi, Ishikawa-Gun (JP); Kentaro Teranishi, Kanazawa (JP)

(73) Assignee: Toshiba Matsushita Display Technology Co, Ltd., Tokyo (JP)

( * ) Notice: Subject to any disclaimer, the term of this patent is extended or adjusted under 35 U.S.C. 154(b) by 120 days.

(21) Appl. No.: 11/044,585

(22) Filed: Jan. 28, 2005

(65) Prior Publication Data

US 2005/0134544 A1 Jun. 23, 2005

Related U.S. Application Data

(63) Continuation of application No. PCT/JP2004/006280, filed on Apr. 30, 2004.

(30) Foreign Application Priority Data

Apr. 30, 2003 (JP) ..... 2003-125612

(51) Int. Cl.
*G09G 3/36* (2006.01)

(52) U.S. Cl. ..... 345/87; 345/93

(58) Field of Classification Search ..... 345/87–100, 345/204

See application file for complete search history.

(56) References Cited

U.S. PATENT DOCUMENTS

| | | | | |
|---|---|---|---|---|
| 6,160,535 | A * | 12/2000 | Park | 345/88 |
| 6,822,718 | B2 * | 11/2004 | Choi et al. | |
| 2003/0151584 | A1 * | 8/2003 | Song et al. | 345/100 |
| 2005/0200585 | A1 * | 9/2005 | Igarashi et al. | 345/93 |

FOREIGN PATENT DOCUMENTS

| | | |
|---|---|---|
| JP | 4-223428 | 8/1992 |
| JP | 10-171412 | 6/1998 |
| JP | 11-102174 | 4/1999 |
| JP | 2001-42287 | 2/2001 |
| JP | 2002-72981 | 3/2002 |

OTHER PUBLICATIONS

U.S. Appl. No. 11/044,585, filed Jan. 28, 2005, Igarashi et al.
U.S. Appl. No. 11/044,204, filed Jan. 28, 2005, Igarashi et al.

* cited by examiner

*Primary Examiner*—Regina Liang
(74) *Attorney, Agent, or Firm*—Oblon, Spivak, McClelland, Maier & Neustadt, P.C.

(57) ABSTRACT

An array substrate includes a plurality of signal lines (X1–Xm) in a display unit (DSP). One switching element is connected per row to each signal line. A switching element in the Nth row of the Mth pixel column and a switching element in the (N+1)th row of the (M+1)th pixel column are connected to the same signal line, and video signals having opposite polarities are supplied to adjacent signal lines.

4 Claims, 11 Drawing Sheets

DISPLAY DEVICE ARRAY SUBSTRATE AND DISPLAY DEVICE

CROSS-REFERENCE TO RELATED APPLICATIONS

This is a Continuation Application of PCT Application No. PCT/JP2004/006280, filed Apr. 30, 2004, which was published under PCT Article 21(2) in Japanese.

This application is based upon and claims the benefit of priority from prior Japanese Patent Application No. 2003-125612, filed Apr. 30, 2003, the entire contents of which are incorporated herein by reference.

BACKGROUND OF THE INVENTION

1. Field of the Invention

The present invention relates to a display device array substrate and display device, and more particularly, to the structure of an array substrate which forms a display device such as a liquid crystal display device.

2. Description of the Related Art

Recently, many flat display devices, represented by liquid crystal display devices, use an active matrix driving system having thin-film transistors each of which functions as a switching element in each of the pixels arranged in a matrix. In display devices like this, the line resistance and line capacitance of lines for transferring signals such as video signals are increasing in accordance with the demands for large screens. This leads to insufficient charging of each pixel, and degrades the display quality. Therefore, it is essential to improve the capability of a signal line driving circuit for driving signal lines (i.e., for supplying predetermined video signals to signal lines).

If the capability of the signal line driving circuit is improved, however, IC chips included in the signal line driving circuit generate heat as the electric power increases. Also improving the capability of the signal line driving circuit complicates the circuit structure, and this increases the cost. Therefore, Jpn. Pat. Appln. KOKAI Publication No. 10-171412, for example, proposes a liquid crystal display device using a dot inversion driving system in which the structure of a signal line driving circuit is simplified. This reference discloses a technique which drives two rows of pixels with one signal line.

In this structure, however, two types of video signals different in polarity must be sequentially supplied to each signal line during one horizontal scanning period. It is also necessary to supply video signals having opposite polarities to each signal line in each horizontal scanning period. This increases the number of times of switching, and increases the load on the signal line driving circuit.

BRIEF SUMMARY OF THE INVENTION

The present invention has been made in consideration of the above situation, and has as its object to provide a display device array substrate and display device capable of preventing deterioration of the display quality, and reducing the load on a driving circuit without increasing the cost.

A display device array substrate according to the first aspect of the present invention is characterized by comprising a plurality of scanning lines running in a row direction on a substrate;

a plurality of signal lines running in a column direction on the substrate; and a display unit having m pixel columns in each of which n rows of pixels are arranged, wherein each pixel includes a switching element placed at an intersection of each scanning line and each signal line, and one switching element is connected per row to each signal line, a switching element in an Nth row of an Mth pixel column and a switching element in an (N+1)th row of an (M+1)th pixel column are connected to the same signal line, and video signals having opposite polarities are supplied to adjacent signal lines.

A display device according to the second aspect of the present invention is characterized by comprising a display device characterized by comprising an array substrate including a plurality of scanning lines running in a row direction on a substrate, a plurality of signal lines running in a column direction on the substrate, and a switching element placed at an intersection of each scanning line and each signal line;

a counter-substrate which opposes the array substrate; and a liquid crystal layer held between the array substrate and counter-substrate, and which has m pixel columns in each of which n pixels are arranged, wherein the display device further comprises:

a scanning line driving circuit which is connected to each scanning line, and outputs a driving signal for driving switching elements connected to the same scanning line;

a controller which rearranges video data in a predetermined order in accordance with an arrangement of the pixels; and a signal line driving circuit which is connected to each signal line, and outputs a video signal to each signal line on the basis of the video data rearranged by the controller, and one switching element is connected per row to each signal line, a switching element in an Nth row of an Mth pixel column and a switching element in an (N+1)th row of an (M+1)th pixel column are connected to the same signal line, and video signals having opposite polarities are supplied to adjacent signal lines.

DETAILED DESCRIPTION OF THE INVENTION

A display device array substrate and display device according to an embodiment of the present invention will be described below with reference to the accompanying drawing. Although the display device array substrate herein mentioned is extensively applicable as an array substrate which forms a flat display device, a liquid crystal display device will be explained as an example of the flat display device.

Figure 1:
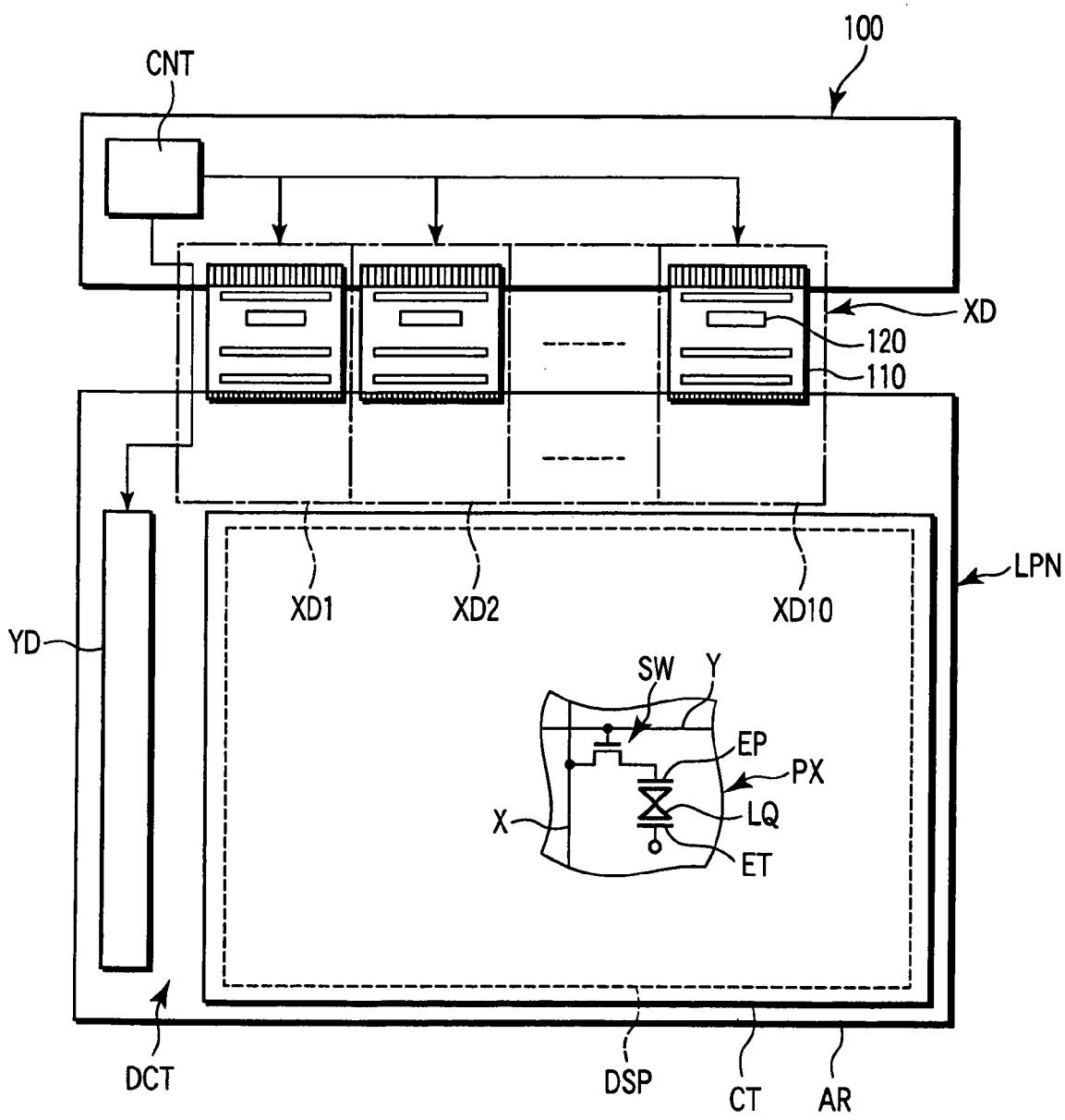
FIG. 1 is a view schematically showing the arrangement of a liquid crystal display device including a display device array substrate according to an embodiment of the present invention.

As shown in FIG. 1, the liquid crystal display device is an active matrix driving type color liquid crystal display device, and includes a liquid crystal display panel LPN, driving printed circuit board (PCB) 100, and the like. The liquid crystal display panel LPN and driving printed circuit board 100 are connected via tape carrier package (TCP) 110. Each TCP 110 is obtained by mounting a signal line driving IC 120 on a flexible printed circuit board. The TCPs 110 are electrically connected to the liquid crystal display panel LPN via, e.g., an anisotropic conductive film (ACF), and connected to the driving printed circuit board 100 by soldering or the like. Although the signal line driving ICs 120 are connected as the TCPs 110 in this embodiment, the signal line driving ICs 120 may also be connected to the liquid crystal display panel LPN by chip on glass (COG). It is also possible to integrate the signal line driving ICs 120 with switching elements of pixels in the liquid crystal display panel LPN in the same process.

The liquid crystal display panel LPN includes an array substrate AR, a counter-substrate CT which opposes the array substrate AR, and a liquid crystal layer LQ held between the array substrate AR and counter-substrate CT. The liquid crystal display panel LPN includes a plurality of pixels PX substantially arranged in an m×n matrix in a display unit DSP having a diagonal length of 32 inches (approximately 81.28 cm).

The array substrate AR has, in the display unit DSP, n scanning lines Y (Y1 to Yn) formed along rows on the substrate, m signal lines X (X1 to Xm) formed along columns on the substrate, m×n switching elements (e.g., thin-film transistors) SW arranged near the intersections of the corresponding scanning lines Y and corresponding signal lines X at individual pixels, m×n pixel electrodes EP connected to the switching elements SW, and the like.

On the other hand, the counter-substrate CT has a single counter-electrode ET and the like in the display unit DSP. The counter-electrode ET opposes the pixel electrodes EP of all the pixels PX.

In a peripheral region DCT of the display unit DSP, the array substrate AR integrally has a scanning line driving circuit YD connected to the n scanning lines Y. The driving printed circuit board 100 includes a controller CNT, power supply circuit (not shown), and the like. The controller CNT rearranges video data in a predetermined order in accordance with the pixel arrangement (to be described later) unique to this embodiment, and outputs the rearranged video data, a polarity signal, various control signals, and the like.

The scanning line driving circuit YD is formed in the same process as the switching elements of the pixels, generates a driving signal for driving the switching elements SW connected to the same scanning line Y, and sequentially outputs driving signals to the n scanning lines Y under the control of the controller CNT.

The signal line driving ICs 120 generate video signals corresponding to the video data rearranged in the predetermined order by the controller CNT, and, under the control of the controller CNT, sequentially outputs the video signals to the m signal lines X at the timing at which the switching elements SW of the individual rows are turned on by driving signals. Consequently, the pixel electrode EP of each pixel PX is set at a pixel potential corresponding to the video signal supplied via the corresponding switching element SW.

The signal line driving ICs 120 are each allocated to a predetermined number of signal lines, thereby forming sections XD1, XD2, . . . , XD10. In this embodiment, 10 signal line driving ICs 120 control the corresponding sections.

In the liquid crystal display panel LPN having the above arrangement, the surface of the array substrate AR and the surface of the counter-substrate CT are covered with orientation films. Also, the array substrate AR and counter-substrate CT are adhered with the surfaces having the orientation films opposing each other. The array substrate AR and counter-substrate CT are adhered via a spacer, and a predetermined gap is formed between them. The liquid crystal layer LQ is made of a liquid crystal composition containing liquid crystal molecules sealed in the gap formed between the orientation film of the array substrate AR and the orientation film of the counter-substrate CT.

Note that the liquid crystal display panel LPN described above can be constructed as either a reflection type display panel which displays images by selectively reflecting ambient light, or a transmission type display panel which displays images by selectively transmitting light from a backlight. To realize this selective reflection or transmission, the liquid crystal display panel LPN includes a deflecting plate or phase difference plate on the outer surface of at least one of the array substrate AR and counter-substrate CT. Also, to make color display possible, the liquid crystal display panel LPN has stripe-shaped color filters of three primary colors, e.g., red, green, and blue, on at least one of the array substrate AR and counter-substrate CT.

Figure 2:
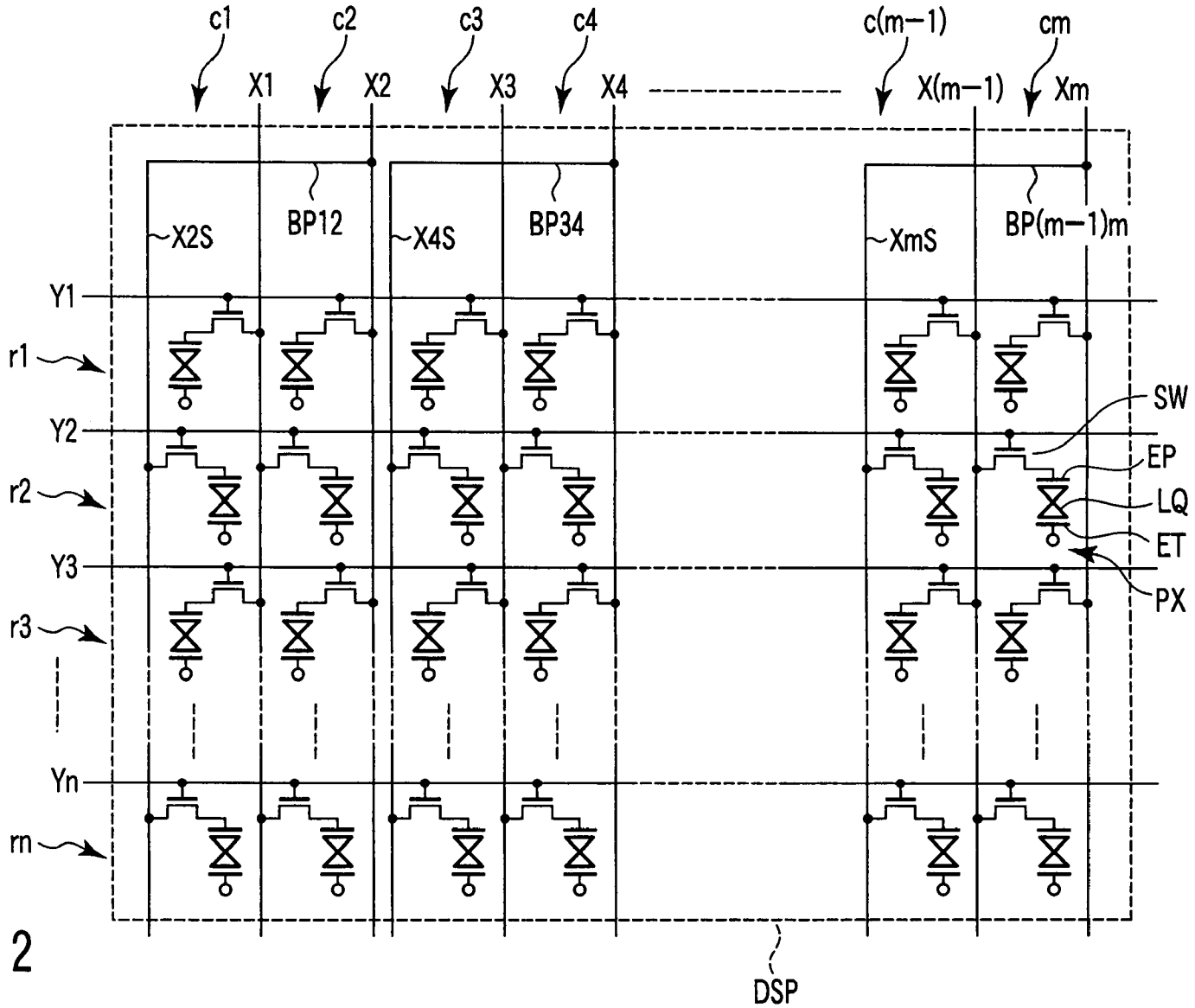
FIG. 2 is a view showing an example of the arrangement of pixels forming a display unit of a display device array substrate according to the first embodiment.
Figure 5:
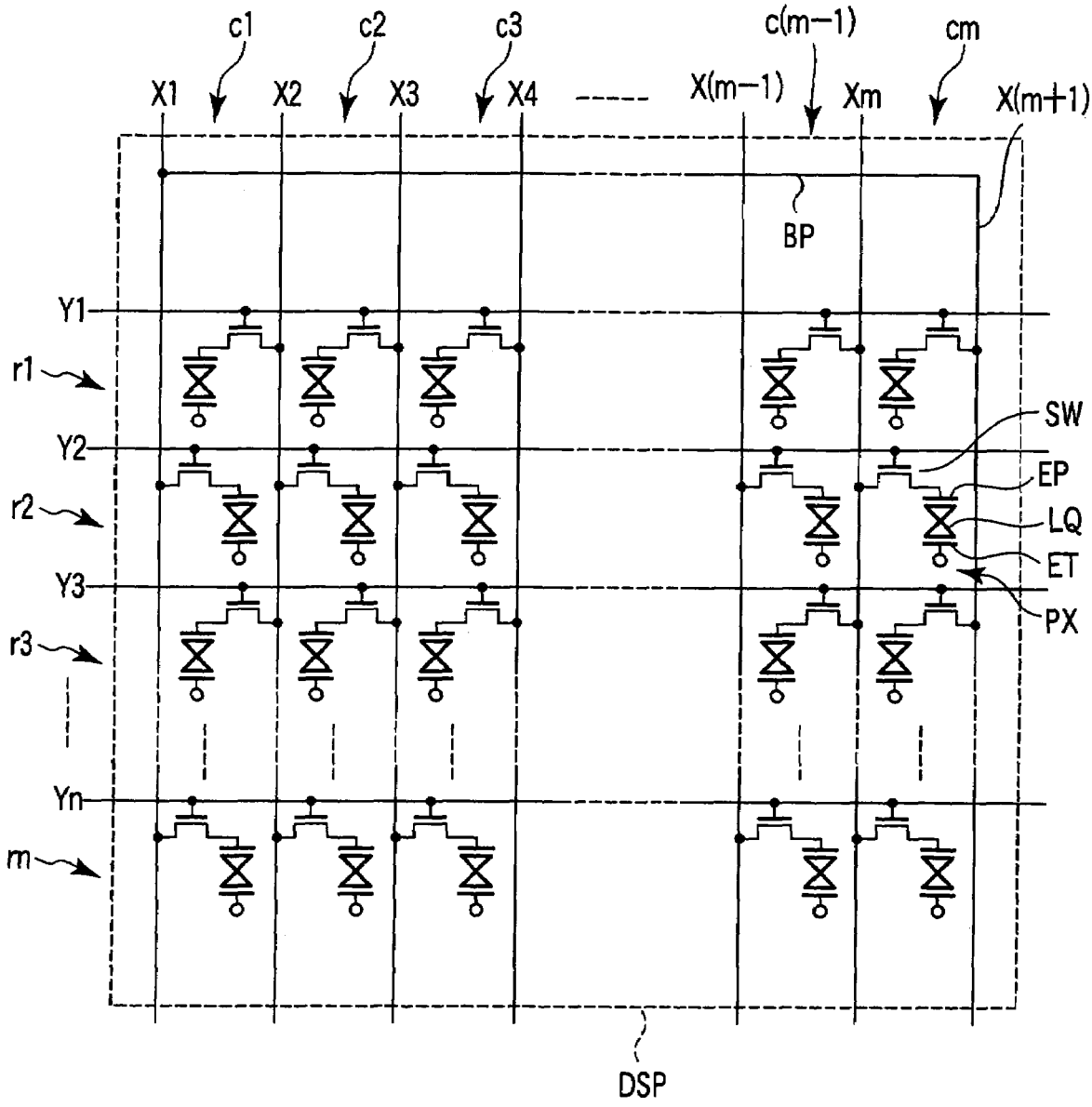
FIG. 5 is a view showing an example of the arrangement of pixels forming a display unit of a display device array substrate according to the second embodiment.
Figure 8:
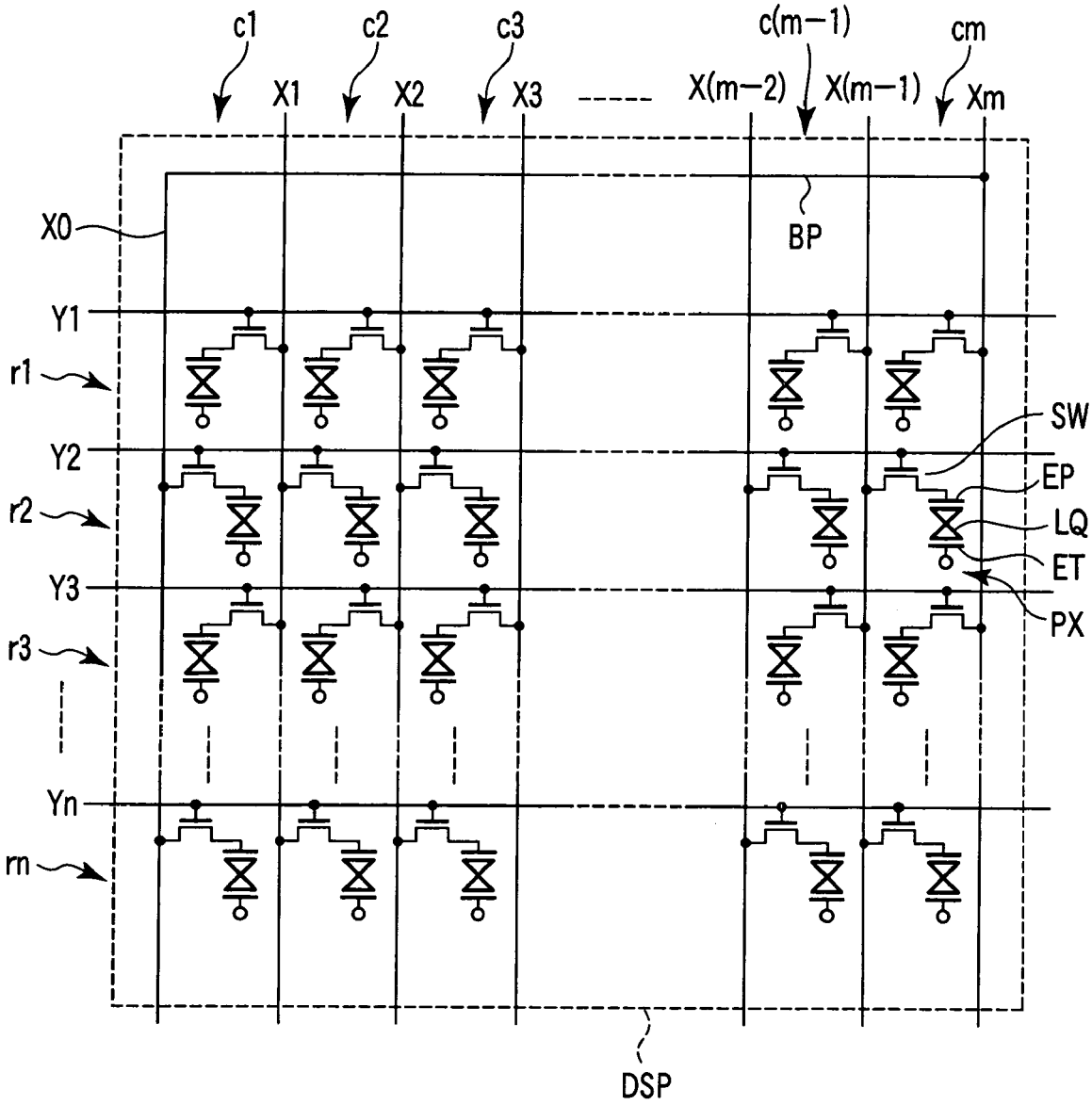
FIG. 8 is a view showing an example of the arrangement of pixels forming a display unit of a display device array substrate according to the third embodiment.

In this embodiment, the array substrate AR includes the pixels PX laid out as shown in FIGS. 2, 5, and 8 in the display unit DSP. That is, the m switching elements SW are connected to the same scanning line Y to form a row r. In this embodiment, n rows r (r1 to rn) are formed in one-to-one correspondence with the n scanning lines Y (Y1 to Yn).

Also, the n switching elements SW are connected to the same signal line X to form a pixel column c. In this embodiment, one switching element is connected per row to each signal line X, and n/2 switching elements SW forming each of two pixel columns are connected to each signal line X. In this manner, the n switching elements are connected by the same pattern to all the signal lines X regardless of whether these switching elements contribute to display, so the capacitances of the individual signal lines can be made equal to each other, and the occurrence of display defects can be prevented. Accordingly, m pixel columns c (c1 to cm) are formed in one-to-one correspondence with the m signal lines X (X1 to Xm). That is, the display unit DSP is made of the m pixel columns in each of which n pixels are arranged.

Furthermore, the switching element SW in the Nth row rN of the Mth pixel column cM and the switching element SW in the (N+1)th row r(N+1) of the (M+1)th pixel column c(M+1) are connected to the same signal line X. Note that each of M and N is an integer of 1 or more in the examples shown in FIGS. 2, 5, and 8.

In the layout shown in FIG. 2, the switching elements SW forming the first pixel column c1 in odd-numbered rows, such as the first, third, fifth, . . . , rows, are connected to the signal line X1 in the first column, and the switching elements SW forming the second pixel column c2 in even-numbered rows, such as the second, fourth, sixth, . . . , nth rows, are connected to the signal line X1 in the first column. That is, the switching elements SW connected to the same signal line are alternately arranged in two pixel columns in every other row.

In this arrangement, the n/2 switching elements SW forming the first pixel column c1 are connected to the signal line X1, and the n/2 switching elements SW forming the second pixel column c2 are similarly connected to the signal line X1.

In the layout shown in FIG. 5, the switching elements SW forming the first pixel column c1 in odd-numbered rows, such as the first, third, fifth, . . . , rows, are connected to the signal line X2 in the second column, and the switching elements SW forming the second pixel column c2 in even-numbered rows, such as the second, fourth, sixth, . . . , nth rows, are connected to the signal line X2 in the second column. That is, the switching elements SW connected to the same signal line are alternately arranged in two pixel columns in every other row.

In this arrangement, the n/2 switching elements SW forming the first pixel column c1 are connected to the signal line X2, and the n/2 switching elements SW forming the second pixel column c2 are similarly connected to the signal line X2.

In the layout shown in FIG. 8, the switching elements SW forming the first pixel column c1 in odd-numbered rows, such as the first, third, fifth, . . . , rows, are connected to the signal line X1 in the first column, and the switching elements SW forming the second pixel column c2 in even-numbered rows, such as the second, fourth, sixth, . . . , nth rows, are connected to the signal line X1 in the first column. That is, the switching elements SW connected to the same signal line are alternately arranged in two pixel columns in every other row.

In this arrangement, the n/2 switching elements SW forming the first pixel column c1 are connected to the signal line X1, and the n/2 switching elements SW forming the second pixel column c2 are similarly connected to the signal line X1.

Also, one pixel column placed between two adjacent signal lines, e.g., one pixel column placed between first and second signal lines adjacent to each other are made up of the switching element SW connected to the first signal line in the Nth row rN, and the switching element SW connected to the second signal line in the (N+1)th row r(N+1).

In a structure in which one pixel column is placed between two adjacent signal lines, one pixel column is desirably formed by connecting all switching elements in odd-numbered rows forming the pixel column to one of adjacent signal lines (i.e., a signal line placed along one side of the pixel column), and all switching elements in even-numbered rows forming the pixel column to the other of the adjacent signal lines (i.e., a signal line placed along the other side of the pixel column).

In the layout shown in FIG. 2, the pixel column c2, for example, placed between the signal line X1 in the first column and the signal line X2 in the second column is made up of the n/2 switching elements SW connected to the signal line (one signal line) X2 in odd-numbered rows such as the first, third, fifth, . . . , rows, and the n/2 switching elements SW connected to the signal line (the other signal line) X1 in even-numbered rows such as the second, fourth, sixth, . . . , nth rows.

In the layout shown in FIG. 5, the pixel column c1, for example, placed between the signal line X1 in the first column and the signal line X2 in the second column is made up of the n/2 switching elements SW connected to the signal line (one signal line) X2 in odd-numbered rows such as the first, third, fifth, . . . , rows, and the n/2 switching elements SW connected to the signal line (the other signal line) X1 in even-numbered rows such as the second, fourth, sixth, . . . , nth rows.

In the layout shown in FIG. 8, the pixel column c2, for example, placed between the signal line X1 in the first column and the signal line X2 in the second column is made up of the n/2 switching elements SW connected to the signal line (one signal line) X2 in odd-numbered rows such as the first, third, fifth, . . . , rows, and the n/2 switching elements SW connected to the signal line (the other signal line) X1 in even-numbered rows such as the second, fourth, sixth, . . . , nth rows.

In the display unit DSP having the above pixel arrangements, dot inversion driving in which pixels adjacent to each other in the row and column directions are given different polarities can be performed by supplying video signals having opposite polarities to adjacent signal lines. In this case, the signal line driving ICs 120 output video signals having the same polarity to the individual signal lines for one frame, i.e., for n horizontal scanning periods (one vertical scanning period) during which n scanning lines are driven.

In the Fth frame (e.g., an odd-numbered frame), for example, the signal line driving ICs 120 output video signals positive with reference to a reference signal to signal lines in odd-numbered columns, such as the signal lines X1, X3, . . . , and output video signals negative with reference to the reference signal to signal lines in even-numbered columns, such as the signal lines X2, X4, . . . .

Also, in the (F+1)th frame (e.g., an even-numbered frame) following the Fth frame, the signal line driving ICs 120 output video signals negative with reference to a reference signal to signal lines in odd-numbered columns, such as the signal lines X1, X3, . . . , and output video signals positive with reference to the reference signal to signal lines in even-numbered columns, such as the signal lines X2, X4, . . . . This makes both dot inversion driving and frame inversion driving possible in the display unit DSP.

As described above, with respect to the same signal line, the signal line driving IC 120 outputs a video signal having the same polarity in, e.g., the same frame (one vertical scanning period), and inverts the polarity of the video signal in each frame. By this dot inversion driving system, the number of times of switching for inverting the polarity of the video signal can be reduced (the number of times of switching can be reduced from, e.g., each horizontal scanning period to each vertical scanning period). Therefore, the load on the signal line driving circuit can be reduced. This makes it possible to eliminate insufficient charging of each pixel, and prevent deterioration of the display quality. It is also possible to simplify the arrangement of the signal line driving circuit, and decrease the cost.

For the display unit DSP having the pixel arrangement as described above, video data must be compensated for by taking account of the relationship between the pixel arrangement and lines. Three embodiments will be described in detail below.

Note that in each embodiment, 1,280 red color filters, 1,280 green color filters, and 1,280 blue color filters are arranged in the form of stripes parallel to the pixel columns in the order of R (Red), G (Green), B (Blue), R, G, . . . . Note also that in FIGS. 3, 6, and 9, the number of each pixel (e.g., "1") indicates a switching element connected to a signal line (e.g., "X1") having the same number. Furthermore, note that in FIGS. 4, 7, and 10, R1, R2, . . . , R1280 correspond to video signals for red pixels, G1, G2, . . . , G1280 correspond to video signals for green pixels, and B1, B2, . . . , B1280 correspond to video signals for blue pixels.

First Embodiment

In this embodiment, as shown in, e.g., FIG. 2, a display DSP comprises a plurality of pairs each including two pixel columns, i.e., the Mth and (M+1)th columns adjacent to each other. Each pair has two signal lines (first and second signal lines) to which video signals output from signal line driving ICs are supplied, and one auxiliary signal line electrically connected to one signal line (e.g., the second signal line). The display unit DSP has m signal lines to which video signals are supplied and m/2 auxiliary signal lines as a whole.

In each pair of the display unit DSP as described above, a switching element in the Nth row of the (M+1)th pixel column is connected to, e.g., the second signal line, and a switching element in the (N+1)th row of the Mth pixel column is connected to the auxiliary signal line which is electrically connected to the second signal line.

For example, in an arrangement in which the auxiliary signal line, first signal line, and second signal line are arranged in this order, and the auxiliary signal line and second signal line are electrically connected via a bypass line, each pair includes a first pixel column placed between the auxiliary signal line and first signal line, and a second pixel column placed between the first and second signal lines. In this case, switching elements in the first and second pixel columns of the Nth row are connected to the first and second signal lines, respectively, and switching elements in the first and second pixel columns of the (N+1)th row are connected to the auxiliary signal line and first signal line, respectively.

In the layout shown in FIG. 2, for example, a first pixel column c1, and a second pixel column c2 adjacent to the first pixel column c1 make a pair. In this pair, a signal line X2 in the second column and an auxiliary signal line X2S are electrically connected via a bypass line BP12. The pixel column c1 is placed between the auxiliary signal line X2S and a signal line X1, and the pixel column c2 is placed between the signal lines X1 and X2. In the Nth row (e.g., an odd-numbered row), a switching element in the pixel column c1 is connected to the signal line X1, and a switching element in the pixel column c2 is connected to the signal line X2. In the (N+1)th row (e.g., an even-numbered row), a switching element in the pixel column c1 is connected to the auxiliary signal line X2S, and a switching element in the pixel column c2 is connected to the signal line X1.

Similarly, in a pair of pixel columns c(m−1) and cm, a signal line Xm in the mth column and an auxiliary signal line XmS are electrically connected via a bypass line BP(m−1)m. The pixel column c(m−1) is placed between the auxiliary signal line XmS and a signal line X(m−1), and the pixel column cm is placed between the signal lines X(m−1) and Xm. In the Nth row (e.g., an odd-numbered row), a switching element in the pixel column c(m−1) is connected to the signal line X(m−1), and a switching element in the pixel column cm is connected to the signal line Xm. In the (N+1)th row (e.g., an even-numbered row), a switching element in the pixel column c(m−1) is connected to the auxiliary signal line XmS, and a switching element in the pixel column cm is connected to the signal line X(m−1).

Figure 3:
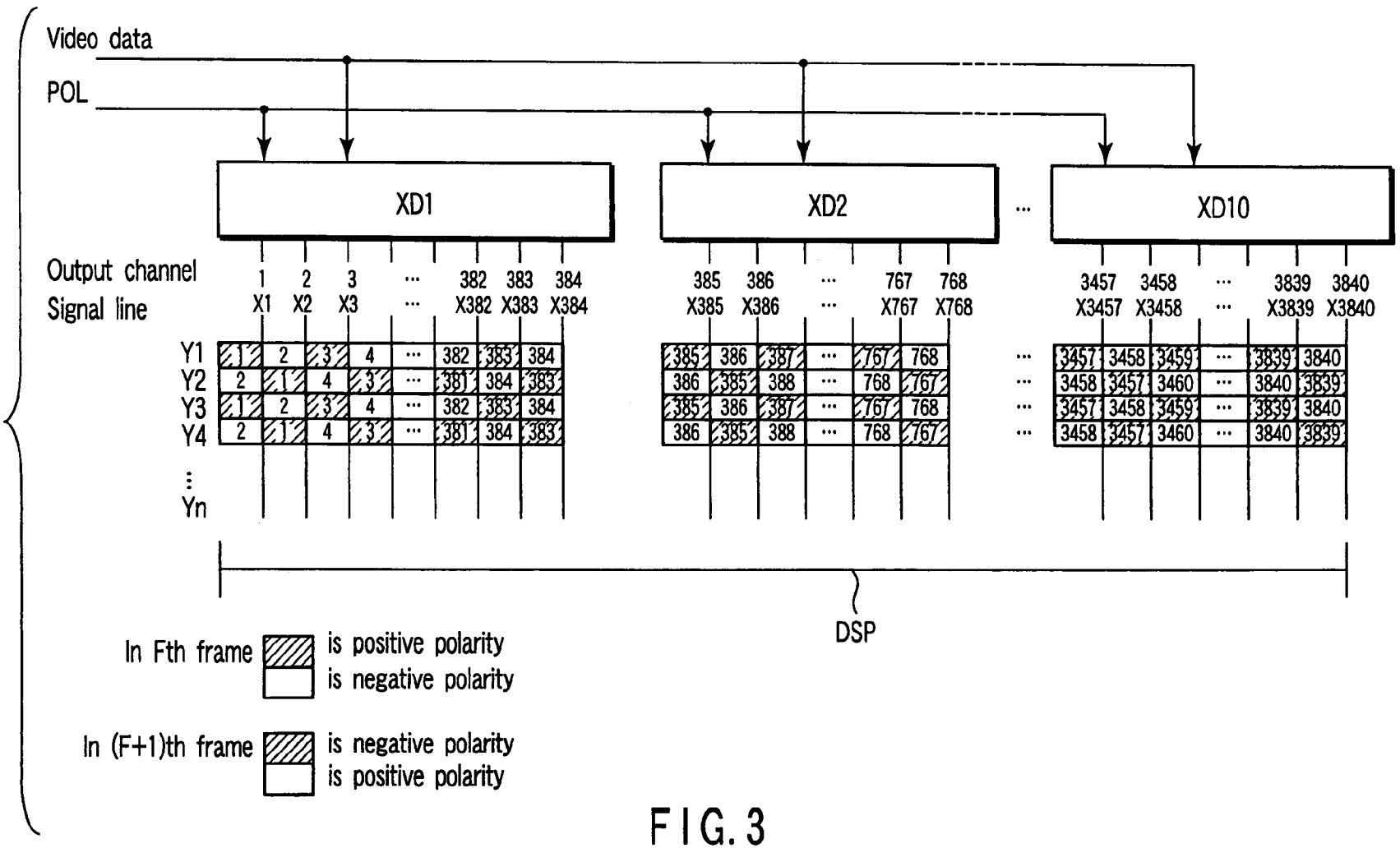
FIG. 3 is a conceptual view for explaining the first embodiment, and is a view for explaining the relationships between output channels and switching elements of pixels connected to signal lines.
Figure 4:
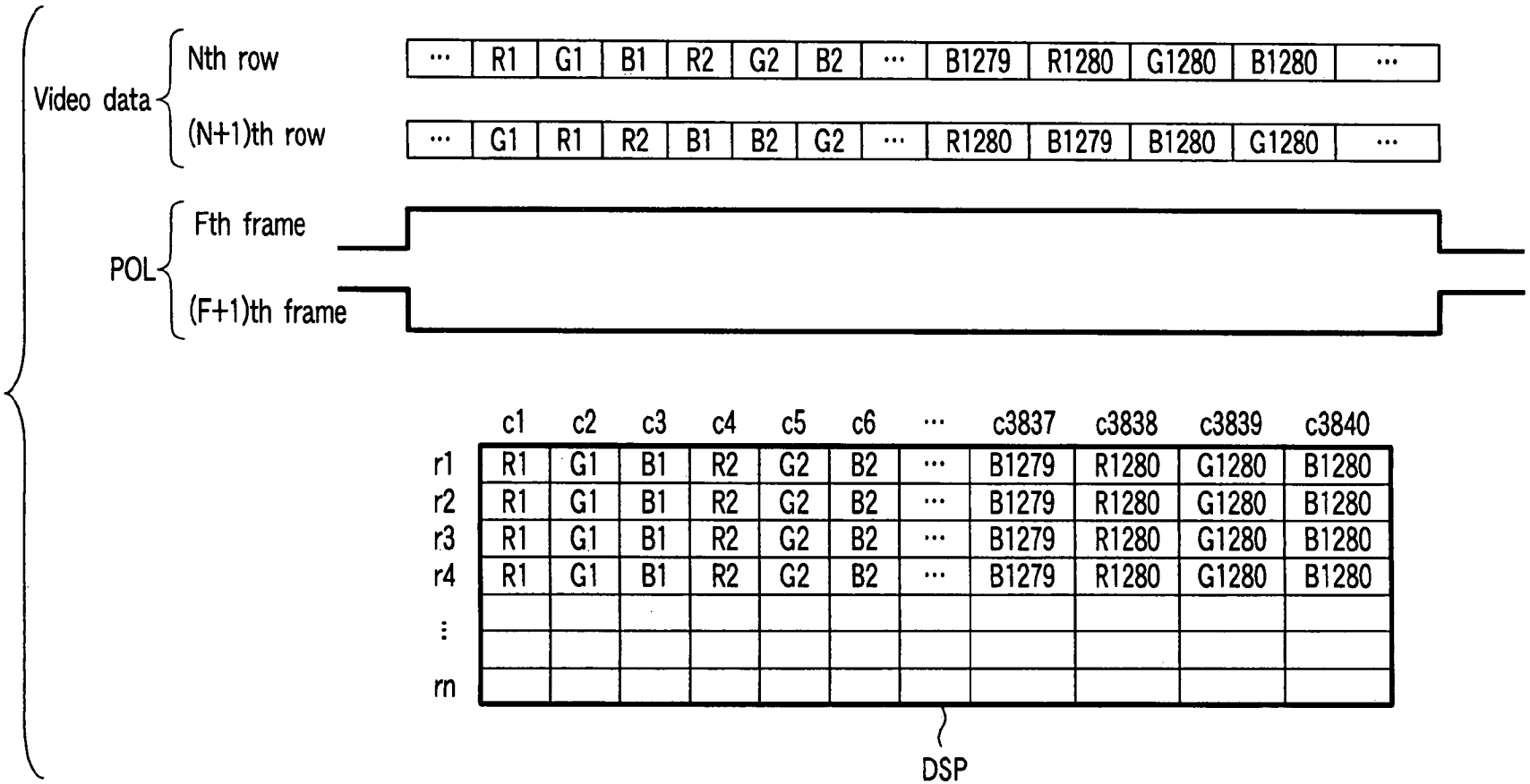
FIG. 4 is a conceptual view for explaining the first embodiment, and is a view for explaining the relationship between video data and a display image displayed on a display unit.

In the first embodiment as shown in FIGS. 3 and 4, the signal line driving ICs have 3,840 output channels for outputting video signals to 3,840 signal lines X1 to X3840, and include 10 sections XD1 to XD10 each allocated to 384 signal lines.

The display unit DSP is substantially formed into a rectangular shape which displays images, and is defined to have m pixel columns in each of which n pixels are arranged. In the example shown in FIG. 3 (and in the examples shown in FIGS. 6 and 9), 3,840 pixel columns from the first pixel column c1 to the 3,840th pixel column c3840 form the display unit DSP.

In the pixel arrangement as shown in FIG. 2, a controller CNT rearranges video data so that a video signal corresponding to the first pixel column is output to the first signal line and a video signal corresponding to the second pixel column is output to the second signal line both at the timing at which a driving signal is output to a scanning line in the Nth row, and a video signal corresponding to the second pixel column is output to the first signal line and a video signal corresponding to the first pixel column is output to the second signal line both at the timing at which a driving signal is output to a scanning line in the (N+1)th row.

That is, in the example (m=3,840) shown in FIGS. 3 and 4, a switching element in the Nth row (e.g., an odd-numbered row) of the pixel column c1 and a switching element in the (N+1)th row (e.g., an even-numbered row) of the pixel column c2 adjacent to the pixel column c1 in the display unit DSP are connected to the signal line X1. In this pixel arrangement, the controller CNT rearranges video data so that a video signal R1 for the pixel column c1 is output to the signal line X1 at the timing at which a driving signal is output to a scanning line (e.g., Y1, Y3, Y5, . . . ) in the Nth row, and a video signal G1 for the pixel column c2 is output to the signal line X1 at the timing at which a driving signal is output to a scanning line (e.g., Y2, Y4, Y6, . . . ) in the (N+1)th row.

Likewise, a switching element in the Nth row (e.g., an odd-numbered row) of the pixel column c2 and a switching element in the (N+1)th row (e.g., an even-numbered row) of the pixel column c1 in the display unit DSP are connected to the signal line X2. In this pixel arrangement, the controller CNT rearranges video data so that the predetermined video signal G1 is output to the signal line X2 at the timing at which a driving signal is output to the scanning line (e.g., Y1, Y3, Y5, . . . ) in the Nth row, and the video signal R1 is output to the signal line X2 at the timing at which a driving signal is output to the scanning line (e.g., Y2, Y4, Y6, . . . ) in the (N+1)th row.

The predetermined video signals R1 and G1 output to the signal lines X1 and X2 at different timings (in different horizontal scanning periods) in the same frame naturally have the same polarity.

Consequently, switching elements SW in the Nth and (N+1)th rows of the pixel column c1 are set at a pixel potential corresponding to the video signal R1. Also, switching elements SW in the Nth and (N+1)th rows of the pixel column c2 are set at a pixel potential corresponding to the video signal G1.

More specifically, the controller CNT rearranges video data into R1, G1, B1, R2, . . . , R1280, G1280, and B1280 at the timing at which the scanning line in the Nth row (e.g., an odd-numbered row) is driven, and outputs the rearranged video data to the signal line driving ICs. The signal line driving ICs serially output the video signals R1, G1, B1, R2, . . . , R1280, G1280, and B1280 to the signal lines X1, X2, X3, X4, . . . , X3838, X3839, and X3840, respectively.

Subsequently, the controller CNT compensates for the video data into G1, R1, R2, B1, . . . , B1279, B1280, and G1280 at the timing at which the scanning line in the (N+1)th row (e.g., an odd-numbered row) is driven, and outputs the rearranged video data to the signal line driving ICs. The signal line driving ICs serially output the video signals G1, R1, R2, B1, . . . , B1279, B1280, and G1280 to the signal lines X1, X2, X3, X4, . . . , X3838, X3839, and X3840, respectively.

By repetitively performing the above signal processing after that, the unique relationship between the lines and pixel arrangement is compensated for by the video signal output order.

Although video signals of 3,840 pixels are sequentially output to the 3,840 signal lines as described above, for each of 1,920 video signal sets each including video signals of two adjacent pixels, video signals of two pixels of each set are alternately rearranged and output to the corresponding signal lines at the timing at which the scanning line in the Nth row is driven and at the timing at which the scanning line in the (N+1)th row is driven.

A polarity signal POL is fixed while pixel potentials are written in all pixels of one frame as described above, and its polarity is inverted in each frame. All the sections XD1 to XD10 of the signal line driving ICs output video signals, having polarities controlled on the basis of the polarity signal POL, to the individual signal lines.

In the Fth frame (e.g., an odd-numbered frame), for example, the polarity signal POL is fixed at HIGH. On the basis of inputting of the polarity signal POL fixed at HIGH, the sections XD1 to XD10 output relatively positive video signals to signal lines in odd-numbered columns, and relatively negative video signals to signal lines in even-numbered columns.

Also, in the (F+1)th frame (e.g., an even-numbered frame) following the Fth frame, the polarity signal POL is fixed at LOW. On the basis of inputting of the polarity signal POL fixed at LOW, the sections XD1 to XD10 output relatively negative video signals to the signal lines in the odd-numbered columns, and relatively positive video signals to the signal lines in the even-numbered columns.

In this manner, dot inversion driving and frame inversion driving are made possible.

Second Embodiment

In the second embodiment as shown in, e.g., FIG. 5, a display DSP has m signal lines to which video signals output from signal line driving ICs are supplied, and one auxiliary signal line electrically connected to one predetermined signal line. In the display unit DSP like this, a switching element in the (N+1)th row of the first pixel column is connected to the predetermined signal line, and a switching element in the Nth row of the mth pixel column is connected to the auxiliary signal line which is electrically connected to the predetermined signal line.

For example, in an arrangement in which the first signal line, second signal line, . . . , mth signal line, and auxiliary signal line are arranged in this order, and the auxiliary signal line and first signal line are electrically connected via a bypass line, the first pixel column is placed between the first and second signal lines, and the mth pixel column is formed between the mth signal line and auxiliary signal line.

In this case, in the Nth row, a switching element in the first pixel column is connected to the second signal line, and a switching element in the mth pixel column is connected to the auxiliary signal line. Also, in the (N+1)th row, a switching element in the first pixel column is connected to the first signal line, and a switching element in the mth pixel column is connected to the mth signal line.

In the layout shown in FIG. 5, in the display unit DSP, signal lines X1, X2, . . . , X(m−1), and Xm are arranged in order over m columns, and an auxiliary signal line X(m+1) is placed adjacent to the signal line Xm. Also, the signal line Xi and auxiliary signal line X(m+1) are electrically connected via a bypass line BP. A first pixel column c1 is placed between the signal lines Xi and X2. An (m−1)th pixel column c(m−1) is placed between the signal lines X(m−1) and Xm. Similarly, an mth pixel column cm is placed between the signal line Xm and auxiliary signal line X(m+1).

In this case, in the Nth row (e.g., an odd-numbered row), a switching element SW in the pixel column c1 is connected to the signal line X2, a switching element SW in the pixel column c(m−1) is connected to the signal line Xm, and a switching element SW in the pixel column cm is connected to the auxiliary signal line X(m+1). In the (N+1)th row (e.g., an even-numbered row), a switching element SW in the pixel column c1 is connected to the first signal line X1, a switching element SW in the pixel column c(m−1) is connected to the signal line X(m−1), and a switching element SW in the pixel column cm is connected to the signal line Xm.

Figure 6:
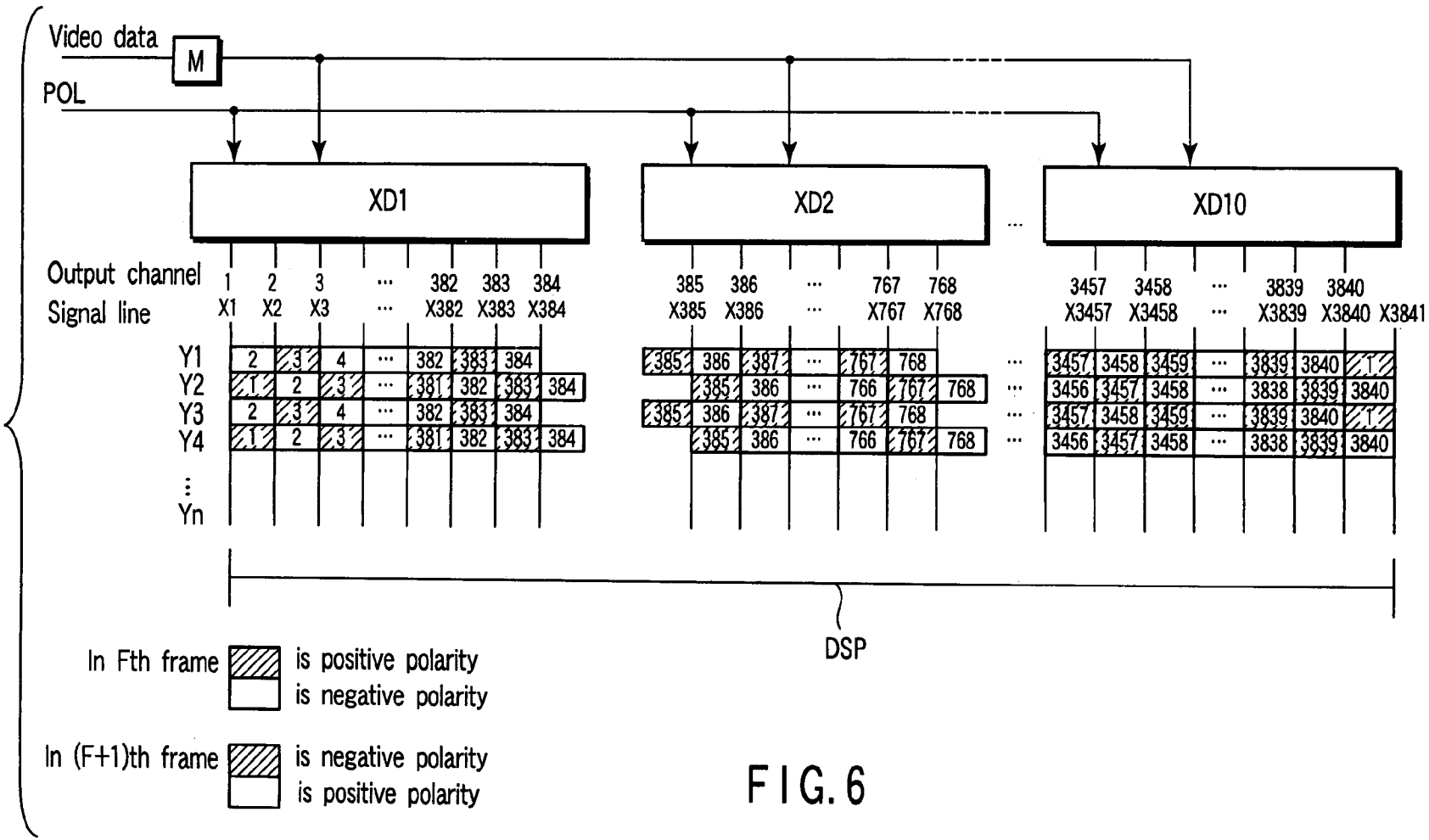
FIG. 6 is a conceptual view for explaining the second embodiment, and is a view for explaining the relationships between output channels and switching elements of pixels connected to signal lines.
Figure 7:
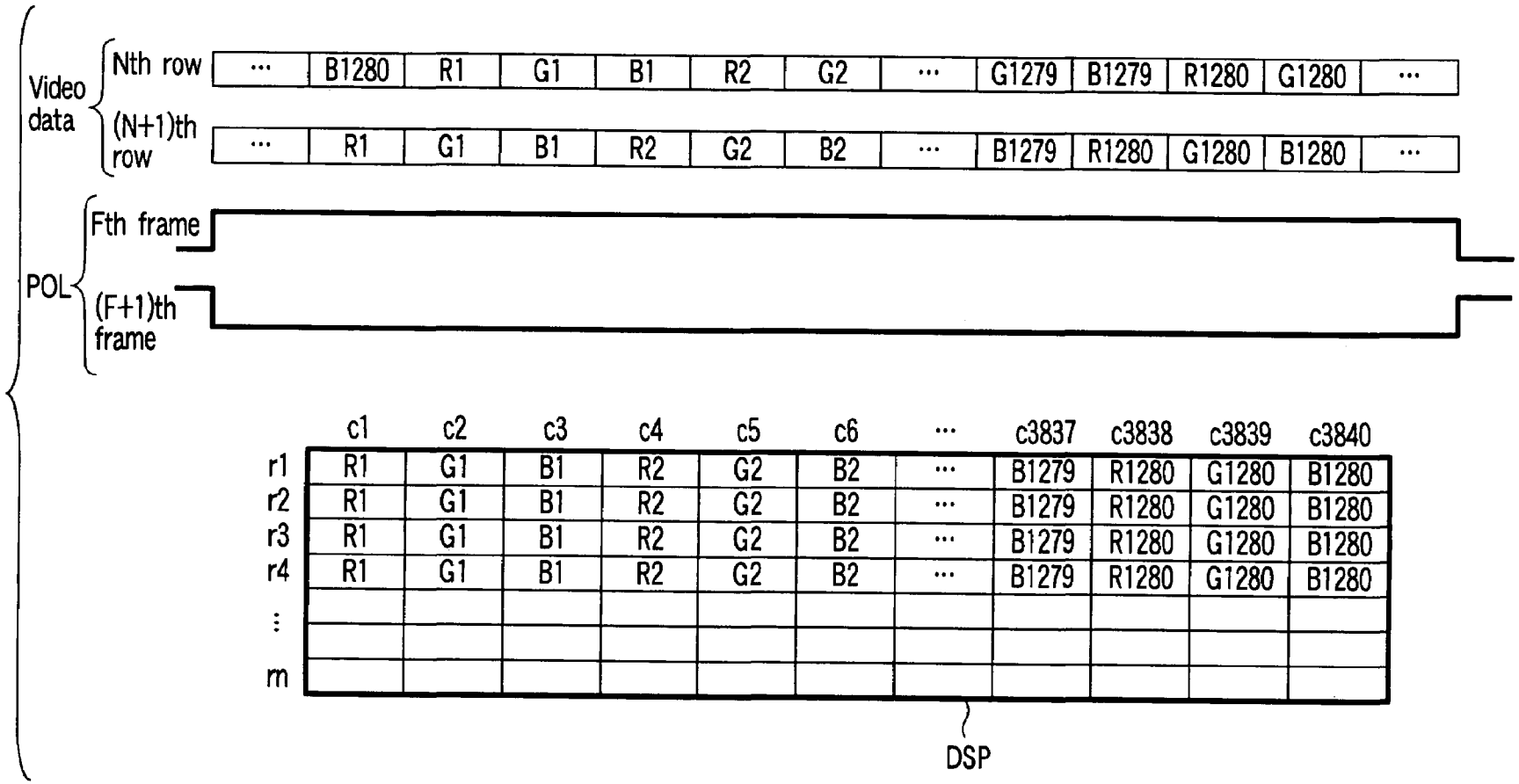
FIG. 7 is a conceptual view for explaining the second embodiment, and is a view for explaining the relationship between video data and a display image displayed on a display unit.

In the second embodiment as shown in FIGS. 6 and 7, the signal line driving ICs have 3,840 output channels for outputting video signals to 3,840 signal lines X1 to X3840, and include 10 sections XD1 to XD10 each allocated to 384 signal lines.

In the pixel arrangement as shown in FIG. 5, a controller CNT rearranges video data so that a video signal corresponding to the mth pixel column is output to the first signal line and a video signal corresponding to the first pixel column is output to the second signal line both at the timing at which a driving signal is output to a scanning line in the Nth row, and a video signal corresponding to the first pixel column is output to the first signal line and a video signal corresponding to the second pixel column adjacent to the first pixel column is output to the second signal line both at the timing at which a driving signal is output to a scanning line in the (N+1)th row.

That is, in the example (m=3,840) shown in FIGS. 6 and 7, a switching element in the Nth row (e.g., an odd-numbered row) of the pixel column c3840 and a switching element in the (N+1)th row (e.g., an even-numbered row) of the pixel column c1 in the display unit DSP are connected to the signal line X1 and auxiliary signal line X(m+1) (i.e., X3841). The signal line X1 and auxiliary signal line X(m+1) are electrically connected via the bypass line BP. In this pixel arrangement, the controller CNT rearranges video data so that a video signal B1280 for the pixel column c3840 is output to the signal line X1 at the timing at which a driving signal is output to a scanning line (e.g., Y1, Y3, Y5, . . . ) in the Nth row, and a video signal R1 for the pixel column c1 is output to the signal line X1 at the timing at which a driving signal is output to a scanning line (e.g., Y2, Y4, Y6, . . . ) in the (N+1)th row.

Likewise, a switching element in the Nth row (e.g., an odd-numbered row) of the pixel column c1 and a switching element in the (N+1)th row (e.g., an even-numbered row) of the pixel column c2 in the display unit DSP are connected to the signal line X2 in the second column. In this pixel arrangement, the controller CNT rearranges video data so that the predetermined video signal R1 for the pixel column c1 is output to the signal line X2 at the timing at which a driving signal is output to the scanning line (e.g., Y1, Y3, Y5, . . . ) in the Nth row, and a video signal G1 for the pixel column c2 is output to the signal line X2 at the timing at which a driving signal is output to the scanning line (e.g., Y2, Y4, Y6, . . . ) in the (N+1)th row.

Naturally, the predetermined video signals B1280 and R1 output to the same signal line X1 at different timings (in different horizontal scanning periods) in the same frame have the same polarity, the predetermined video signals R1 and G1 output to the same signal line X2 also have the same polarity, but the polarities of video signals output to the signal lines X1 and X2 are opposite to each other.

Consequently, the switching elements SW in the Nth and (N+1)th rows of the pixel column c1 are set at a pixel potential corresponding to the video signal R1. Also, the switching elements SW in the Nth and (N+1)th rows of the pixel column c2 are set at a pixel potential corresponding to the video signal G1. Furthermore, the switching elements SW in the Nth and (N+1)th rows of the pixel column c3840 are set at a pixel potential corresponding to the video signal B1280.

More specifically, the controller CNT rearranges video data into B1280, R1, G1, B1, . . . , B1279, R1280, and G1280 and outputs the rearranged video data to the signal line driving ICs at the timing at which the scanning line in the Nth row (e.g., an odd-numbered row) is driven. The signal line driving ICs serially output the video signals B1280, R1, G1, B1, . . . , B1279, R1280, and G1280 to the signal lines X1, X2, X3, X4, . . . , X3838, X3839, and X3840, respectively.

Subsequently, the controller CNT rearranges the video data into R1, G1, B1, R2, . . . , R1280, G1280, and B1280 and outputs the rearranged video data to the signal line driving ICs at the timing at which the scanning line in the (N+1)th row (e.g., an odd-numbered row) is driven. The signal line driving ICs serially output the video signals R1, G1, B1, R2, . . . , R1280, G1280, and B1280 to the signal lines X1, X2, X3, X4, . . . , X3838, X3839, and X3840, respectively.

By repetitively performing the above signal processing after that, the unique relationship between the lines and pixel arrangement is compensated for by the output order of the video signals.

Although video signals of 3,840 pixels are sequentially output to the 3,840 signal lines as described above, video signals arranged in a predetermined order at the timing at which the scanning line in the (N+1)th row is driven need only be rearranged so that a video signal to be supplied to the final pixel column cm is output to the first signal line at the timing at which the scanning line in the Nth row is driven. Accordingly, a line memory M for temporarily storing video data of one horizontal scanning period is necessary to rearrange the video signals at the timing at which the scanning line in the Nth row is driven, but the signal processing required to rearrange the video signals is simpler than that in the first embodiment, so the load on the circuit can be reduced.

As in the first embodiment, a polarity signal POL is fixed while pixel potentials are written in all pixels of one frame, and its polarity is inverted in each frame. All the sections XD1 to XD10 of the signal line driving ICs output video signals, having polarities controlled on the basis of the polarity signal POL, to the individual signal lines.

In the Fth frame (e.g., an odd-numbered frame), for example, the polarity signal POL is fixed at HIGH. On the basis of inputting of the polarity signal POL fixed at HIGH, the sections XD1 to XD10 output relatively positive video signals to signal lines in odd-numbered columns, and relatively negative video signals to signal lines in even-numbered columns.

Also, in the (F+1)th frame (e.g., an even-numbered frame) following the Fth frame, the polarity signal POL is fixed at LOW. On the basis of inputting of the polarity signal POL fixed at LOW, the sections XD1 to XD10 output relatively negative video signals to the signal lines in the odd-numbered columns, and relatively positive video signals to the signal lines in the even-numbered columns.

In this manner, dot inversion driving and frame inversion driving are made possible.

Additionally, the number of auxiliary signal lines in the second embodiment is smaller than that in the first embodiment. That is, in the second embodiment, only an auxiliary signal line is placed adjacent to the final pixel column. Therefore, when array substrates are formed with the same substrate area in accordance with the individual embodiments, an aperture ratio per pixel higher than that in the first embodiment can be ensured in the second embodiment.

Third Embodiment

In the third embodiment as shown in, e.g., FIG. 8, a display DSP has m signal lines to which video signals output from signal line driving ICs are supplied, and one auxiliary signal line electrically connected to one predetermined signal line. In the display unit DSP like this, a switching element in the Nth row of the mth pixel column is connected to the predetermined signal line, and a switching element in the (N+1)th row of the first pixel column is connected to the auxiliary signal line which is electrically connected to the predetermined signal line.

For example, in an arrangement in which the auxiliary signal line, first signal line, second signal line, . . . , and mth signal line are arranged in this order, and the auxiliary signal line and mth signal line are electrically connected via a bypass line, the first pixel column is placed between the auxiliary signal line and first signal line, and the mth pixel column is placed between the (m−1)th and mth signal lines.

In this case, in the Nth row, a switching element in the first pixel column is connected to the first signal line, and a switching element in the mth pixel column is connected to the mth signal line. Also, in the (N+1)th row, a switching element in the first pixel column is connected to the auxiliary signal line, and a switching element in the mth pixel column is connected to the (m−1)th signal line.

In the layout shown in FIG. 8, in the display unit DSP, signal lines X1, X2, . . . , X(m−1), and Xm are arranged in order over m columns, and an auxiliary signal line X0 is placed adjacent to the signal line X1. Also, the signal line Xm and auxiliary signal line X0 are electrically connected via a bypass line BP. A first pixel column c1 is placed between the auxiliary signal line X0 and signal line X1. A second pixel column c2 is placed between the signal lines X1 and X2. An (m−1)th pixel column c(m−1) is placed between the signal lines X(m−2) and X(m−1). Likewise, an mth pixel column cm is placed between the signal lines X(m−1) and Xm.

In this case, in the Nth row (e.g., an odd-numbered row), a switching element SW in the pixel column c1 is connected to the signal line X1, a switching element SW in the pixel column c2 is connected to the signal line X2, a switching element SW in the pixel column c(m−1) is connected to the signal line X(m−1), and a switching element SW in the pixel column cm is connected to the signal line Xm. Also, in the (N+1)th row (e.g., an even-numbered row), a switching element SW in the pixel column c1 is connected to the auxiliary signal line X0, a switching element SW in the pixel column c2 is connected to the signal line X1, a switching element SW in the pixel column c(m−1) is connected to the signal line X(m−2), and a switching element SW in the pixel column cm is connected to the signal line X(m−1).

Figure 9:
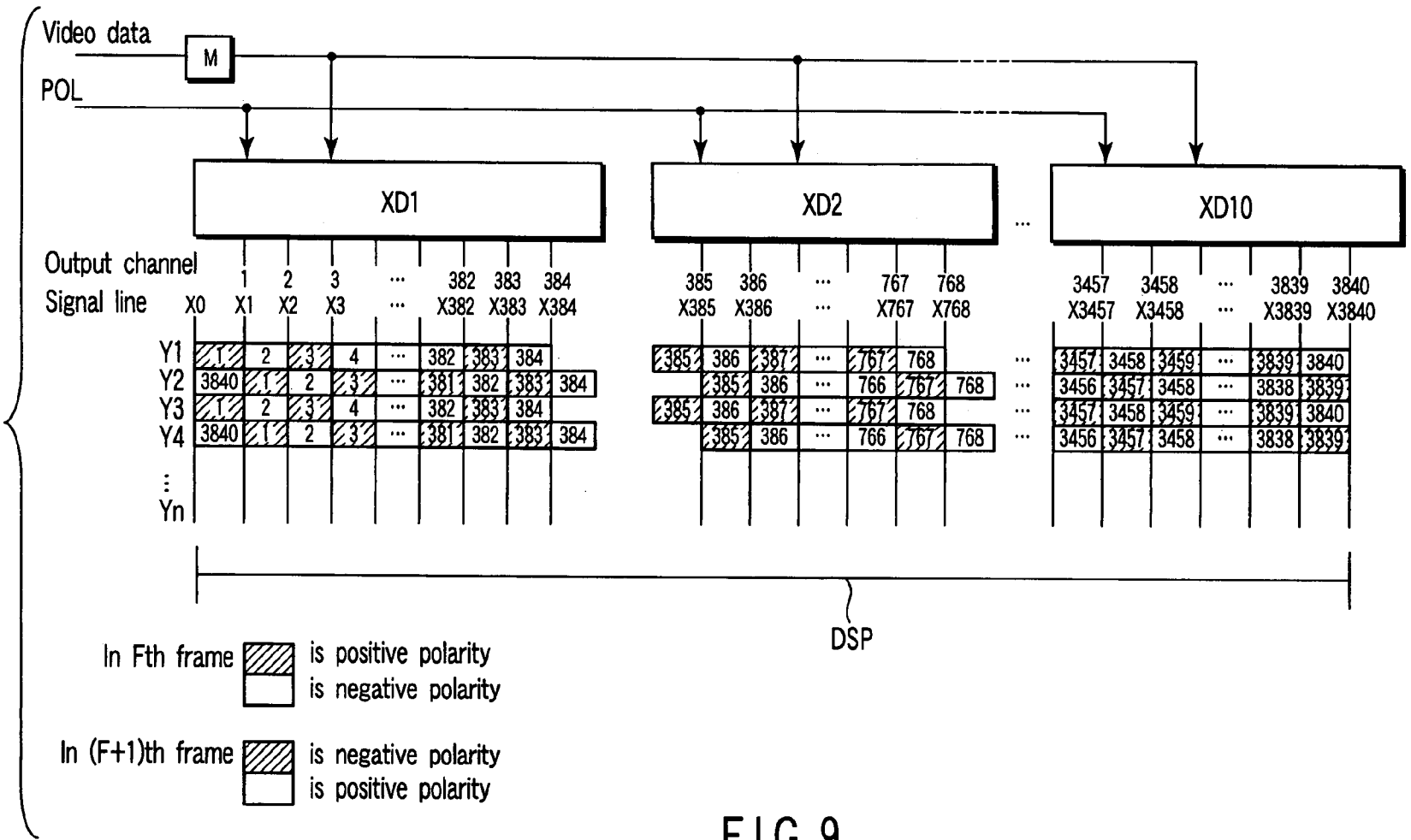
FIG. 9 is a conceptual view for explaining the third embodiment, and is a view for explaining the relationships between output channels and switching elements of pixels connected to signal lines.
Figure 10:
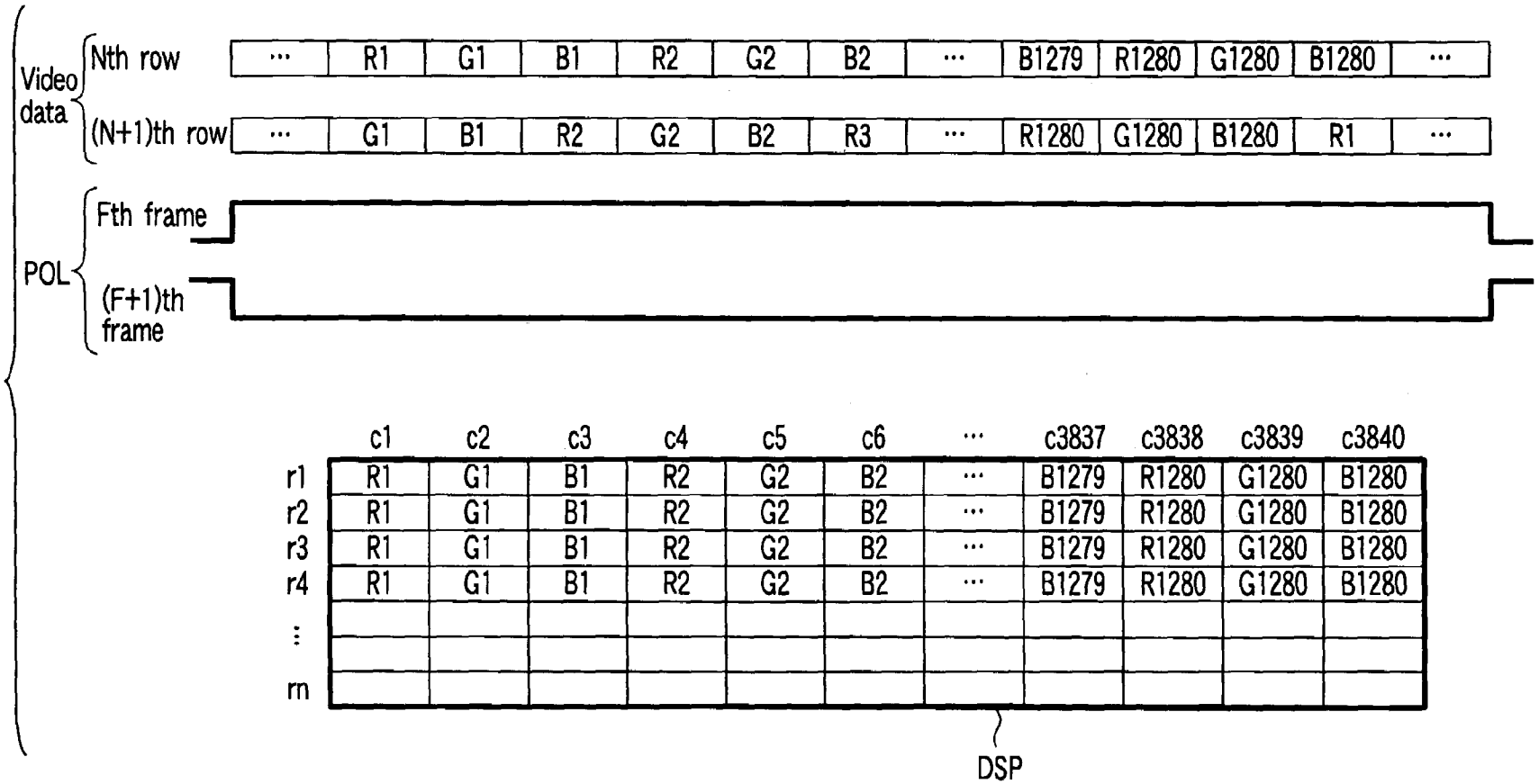
FIG. 10 is a conceptual view for explaining the third embodiment, and is a view for explaining the relationship between video data and a display image displayed on a display unit.

In the third embodiment as shown in FIGS. 9 and 10, the signal line driving ICs have 3,840 output channels for outputting video signals to 3,840 signal lines X1 to X3840, and include 10 sections XD1 to XD10 each allocated to 384 signal lines.

In the pixel arrangement as shown in FIG. 8, a controller CNT rearranges video data so that a video signal corresponding to the first pixel column is output to the first signal line and a video signal corresponding to the mth pixel column is output to the mth signal line both at the timing at which a driving signal is output to a scanning line in the Nth row, and a video signal corresponding to the second pixel column adjacent to the first pixel column is output to the first signal line and a video signal corresponding to the first pixel column is output to the mth pixel column both at the timing at which a driving signal is output to a scanning line in the (N+1)th row.

That is, in the example (m=3,840) shown in FIGS. 9 and 10, a switching element in the Nth row (e.g., an odd-numbered row) of the pixel column c3840 and a switching element in the (N+1)th row (e.g., an even-numbered row) of the pixel column c1 in the display unit DSP are connected to the signal line X3840 and auxiliary signal line X0. The signal line X3840 and auxiliary signal line X0 are electrically connected via the bypass line BP. In this pixel arrangement, the controller CNT rearranges video data so that a video signal B1280 for the pixel column c3840 is output to the signal line X3840 at the timing at which a driving signal is output to a scanning line (e.g., Y1, Y3, Y5, . . . ) in the Nth row, and a video signal R1 for the pixel column c1 is output to the signal line X3840 at the timing at which a driving signal is output to a scanning line (e.g., Y2, Y4, Y6, . . . ) in the (N+1)th row.

Likewise, a switching element in the Nth row (e.g., an odd-numbered row) of the pixel column c1 and a switching element in the (N+1)th row (e.g., an even-numbered row) of the pixel column c2 in the display unit DSP are connected to the signal line X1. In this pixel arrangement, the controller CNT rearranges video data so that the video signal R1 for the pixel column c1 is output to the signal line X1 at the timing at which a driving signal is output to the scanning line (e.g., Y1, Y3, Y5, . . . ) in the Nth row, and a video signal G1 for the pixel column c2 is output to the signal line X1 at the timing at which a driving signal is output to the scanning line (e.g., Y2, Y4, Y6, . . . ) in the (N+1)th row.

Naturally, the predetermined video signals B1280 and R1 output to the same signal line X3840 at different timings (in different horizontal scanning periods) in the same frame have the same polarity, the predetermined video signals R1 and G1 output to the same signal line X1 also have the same polarity, but the polarities of video signals output to the signal lines X1 and X3840 are opposite to each other.

Consequently, the switching elements SW in the Nth and (N+1)th rows of the pixel column c1 are set at a pixel potential corresponding to the video signal R1. Also, the switching elements SW in the Nth and (N+1)th rows of the pixel column c2 are set at a pixel potential corresponding to the video signal G1. Furthermore, the switching elements SW in the Nth and (N+1)th rows of the pixel column c3840 are set at a pixel potential corresponding to the video signal B1280.

More specifically, the controller CNT rearranges video data into R1, G1, B1, . . . , B1279, R1280, G1280, and B1280 and outputs the rearranged video data to the signal line driving ICs at the timing at which the scanning line in the Nth row (e.g., an odd-numbered row) is driven. The signal line driving ICs serially output the video signals R1, G1, B1, . . . , B1279, R1280, G1280, and B1280 to the signal lines X1, X2, X3, . . . , X3837, X3838, X3839, and X3840, respectively.

Subsequently, the controller CNT rearranges video data into G1, B1, R2, . . . , R1280, G1280, B1280, and R1 and outputs the rearranged video data to the signal line driving ICs at the timing at which the scanning line in the (N+1)th row (e.g., an odd-numbered row) is driven. The signal line driving ICs serially output the video signals G1, B1, R2, . . . , R1280, G1280, B1280, and R1 to the signal lines X1, X2, X3, . . . , X3837, X3838, X3839, and X3840, respectively.

By repetitively performing the above signal processing after that, the unique relationship between the lines and pixel arrangement is compensated for by the video signal output order.

Although video signals of 3,840 pixels are sequentially output to the 3,840 signal lines as described above, video signals arranged in a predetermined order at the timing at which the scanning line in the Nth row is driven need only be rearranged so that a video signal to be supplied to the first pixel column c1 is output to the final signal line at the timing at which the scanning line in the (N+1)th row is driven. Accordingly, a line memory M for temporarily storing video data of one horizontal scanning period is necessary to rearrange the video signals at the timing at which the scanning line in the (N+1)th row is driven, but the signal processing required to rearrange the video signals is simpler than that in the first embodiment, so the load on the circuit can be reduced. In addition, the memory M does not require the capacity for storing video data of one horizontal scanning period unlike in the second embodiment, so the cost can be reduced.

As in the first embodiment, a polarity signal POL is fixed while pixel potentials are written in all pixels of one frame, and its polarity is inverted in each frame. All the sections XD1 to XD10 of the signal line driving ICs output video signals, having polarities controlled on the basis of the polarity signal POL, to the individual signal lines.

In the Fth frame (e.g., an odd-numbered frame), for example, the polarity signal POL is fixed at HIGH. On the basis of inputting of the polarity signal POL fixed at HIGH, the sections XD1 to XD10 output relatively positive video signals to signal lines in odd-numbered columns, and relatively negative video signals to signal lines in even-numbered columns.

Also, in the (F+1)th frame (e.g., an even-numbered frame) following the Fth frame, the polarity signal POL is fixed at LOW. On the basis of inputting of the polarity signal POL fixed at LOW, the sections XD1 to XD10 output relatively negative video signals to the signal lines in the odd-numbered columns, and relatively positive video signals to the signal lines in the even-numbered columns.

In this manner, dot inversion driving and frame inversion driving are made possible.

Additionally, the number of auxiliary signal lines in the third embodiment is smaller than that in the first embodiment. Therefore, when array substrates are formed with the same substrate area in accordance with the individual embodiments, an aperture ratio per pixel higher than that in the first embodiment can be ensured in the third embodiment.

As described above, the display device array substrate according to this embodiment includes a rectangular display unit having n rows×m columns, one switching element is connected per row to each signal line, a switching element in the Nth row of the Mth pixel column and a switching element in the (N+1)th row of the (M+1)th pixel column are connected to the same signal line, and video signals having opposite polarities are supplied to adjacent signal lines, thereby making dot inversion driving possible. Also, during this dot inversion driving, video signals having the same polarity are supplied to the same signal line over one frame, i.e., n horizontal scanning periods (one vertical scan period). In addition, video signals having opposite polarities are alternately supplied to each signal line in every other frame, thereby making frame inversion driving possible. This reduces the load on the signal line driving IC.

Also, each pixel can be reliably charged. In addition, since the polarities of the applied voltages to adjacent pixel columns are changed, no flicker occurs, and deterioration of the display quality can be prevented even when the screen size is increased. Furthermore, the arrangement of the signal line driving ICs can be simplified.

The liquid crystal display panel LPN according to the above embodiment was able to display images having high display quality although, for example, the wiring capacitance was 180 pF and the wiring resistance was 3 kΩ in the display unit DSP having a diagonal length of 32 inches. Also, this embodiment was able to display images having high display quality even when the wiring resistance increased to 300 pF by changes in layout of the array substrate.

The controller which outputs vide data to the signal line driving ICs rearranges the video data in accordance with the special pixel arrangement described above. Therefore, normal images can be displayed on the effective display unit formed by the special pixel arrangement.

Although display device array substrates applied to liquid crystal display devices are explained in the above embodiments, the present invention is also applicable to other display devices, e.g., flat display devices such as an organic electroluminescence (EL) display device.

Figure 11:
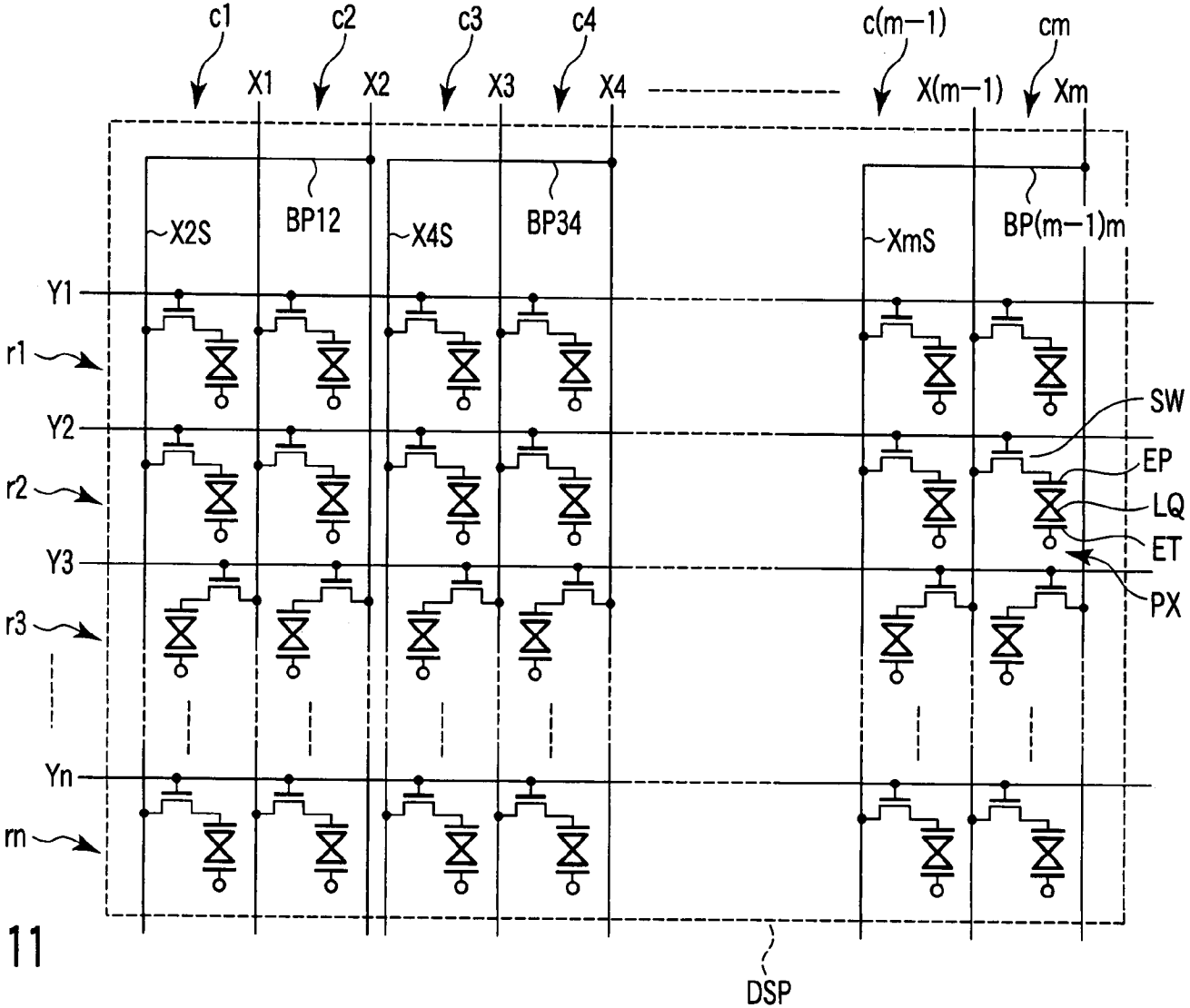
FIG. 11 is a view showing another example of the arrangement of the pixels forming the display unit of the display device array substrate according to the first embodiment.

Also, in the first to third embodiments the switching elements SW connected to one signal line are alternately arranged in two pixel columns in every other row, but the present invention is not limited to these embodiments. That is, the switching elements SW connected to one signal line may also be alternately arranged in two pixel columns in every two or more rows. For example, in the arrangement of the first embodiment as shown in FIG. 11, the switching elements SW in the Nth row rN and (N+1)th row r(N+1) of the Mth pixel column cM and the switching elements SW in the (N+2)th row r(N+2) and (N+3)th row r(N+3) of the (M+1)th pixel column c(M+1) are connected to the same signal line X. That is, the switching elements SW connected to one signal line are alternately arranged in two pixel columns in every two rows. Even when the display unit is formed by this pixel arrangement, the same effect is obtained by rearranging video data in the same manner as above.

Note that in order to prevent deterioration of the display quality such as flicker, the repeating period in which switching elements connected to the same signal line are alternately arranged in two pixel columns is desirably four rows or less.

The polarity inversion timing of video signals output from the signal line driving ICs is not limited to one frame. For example, the polarity inversion timing may also be two frames or more, but is desirably 10 frames or less in order to prevent the wear on the screen.

Also, in the second and third embodiments, the bypass line for connecting one signal line and one auxiliary signal line desirably runs on the driving circuit substrate 100 via the TCP 110 without crossing signal lines between them. This eliminates the formation of any unwanted capacitance between each signal line and the bypass line, and makes it possible to stably supply video signals to each signal line.

Furthermore, the relationship between the Mth and (M+1) th columns corresponds to any adjacent pixel columns, so these columns are not particularly limited to an even-numbered column and odd-numbered column. Similarly, the relationship between the Nth and (N+1)th rows corresponds to any adjacent rows, so these rows are not particularly limited to an even-numbered row and odd-numbered row.

The present invention naturally includes a case in which a switching element in the Nth row of the (M+1)th pixel column and a switching element in the (N+1)the row of the M pixel column are connected to the same signal line, and a case in which a switching element in the Nth row of the Mth pixel column and a switching element in the (N+1)th row of the (M+1)th pixel column is connected to the same signal line.

Note that the present invention is not directly limited to the embodiments described above, but can be embodied by modifying the constituent elements, when the invention is practiced, without departing from the spirit and scope of the invention. Note also that various inventions can be formed by appropriately combining a plurality of constituent elements disclosed in the embodiments. For example, it is also possible to delete some of all the constituent elements disclosed in the embodiments. Furthermore, constituent elements disclosed over different embodiments may also be appropriately combined.

As has been explained above, the present invention can provide a display device array substrate and display device capable of preventing deterioration of the display quality, and reducing the load on a driving circuit without increasing the cost.

What is claimed is:

1. A display device array substrate, comprising:

a plurality of scanning lines running in a row direction on a substrate;

a plurality of signal lines running in a column direction on the substrate; and a display unit having m pixel columns in each of which n rows of pixels are arranged, wherein each pixel includes a switching element placed at an intersection of each scanning line and each signal line, and one switching element is connected per row to each signal line, a switching element in an Nth row of an Mth pixel column and a switching element in an (N+1)th row of an (M+1)th pixel column are connected to the same signal line, and video signals having opposite polarities are supplied to adjacent signal lines, wherein the display unit includes a first pixel column placed between first and second signal lines, and an mth pixel column placed between an mth signal line and an auxiliary signal line electrically connected to the first signal line, switching elements in the first and mth pixel columns of the Nth row are connected to the second signal line and auxiliary signal line, respectively, and switching elements in the first and mth pixel lines of the (N+1)th row are connected to the first and mth signal lines, respectively, wherein each of N, and M is an integer of 1 or more, and each of n, m is an integer of 2 or more.

2. A display device array substrate according to claim 1, wherein a video signal corresponding to the mth pixel column is supplied to the first signal line and a video signal corresponding to the first pixel column is output to the second signal line both at a timing at which switching elements in the Nth row are driven, and a video signal corresponding to the first pixel column is supplied to the first signal line and a video signal corresponding to a second pixel column adjacent to the first pixel column is supplied to the second signal line both at a timing at which switching elements in the (N+1)th row are driven.

3. A display device array substrate, comprising:

a plurality of scanning lines running in a row direction on a substrate;

a plurality of signal lines running in a column direction on the substrate; and a display unit having m pixel columns in each of which n rows of pixels are arranged, wherein each pixel includes a switching element placed at an intersection of each scanning line and each signal line, and one switching element is connected per row to each signal line, a switching element in an Nth row of an Mth pixel column and a switching element in an (N+1)th row of an (M+1)th pixel column are connected to the same signal line, and video signals having opposite polarities are supplied to adjacent signal lines, wherein the display unit includes an mth pixel column placed between (m−1)th and mth signal lines, and a first pixel column placed between an auxiliary signal line electrically connected to the mth signal line and a first signal line, switching elements in the first and mth pixel columns of the Nth row are connected to the first and mth signal lines, respectively, and switching elements in the first and mth pixel columns of the (N+1)th row are connected to the auxiliary signal line and (m−1)th signal line, respectively, wherein each of N, and M is an integer of 1 or more, and each of n, m is an integer of 2 or more.

4. A display device array substrate according to claim 3, wherein a video signal corresponding to the first pixel column is supplied to the first signal line and a video signal corresponding to the mth pixel column is output to the mth signal line both at a timing at which switching elements in the Nth row are driven, and a video signal corresponding to a second pixel column adjacent to the first pixel column is supplied to the first signal line and a video signal corresponding to the first pixel column is supplied to the mth signal line both at a timing at which switching elements in the (N+1)th row are driven.

* * * * *